United States Patent [19]

Berger

[11] Patent Number: 4,682,449

[45] Date of Patent: Jul. 28, 1987

[54] RETRACTABLE STADIUM ROOF SYSTEM WITH RECTANGULAR OPENING

[76] Inventor: Horst L. Berger, 18 Chestnut Dr., Hastings-on-Hudson, N.Y. 10706

[21] Appl. No.: 913,520

[22] Filed: Sep. 30, 1986

[51] Int. Cl.[4] ..... E04B 7/16

[52] U.S. Cl. ..... 52/66; 52/64; 52/83

[58] Field of Search ..... 52/66, 64, 83

[56] References Cited

U.S. PATENT DOCUMENTS

| | | | |
|---|---|---|---|
| 1,347,815 | 7/1920 | Le Cocq | 52/64 |
| 1,566,521 | 12/1925 | Brinton | 52/83 |
| 2,052,217 | 8/1936 | DeSibour et al. | 52/64 X |
| 2,126,413 | 8/1938 | Respess | 52/83 |
| 3,552,072 | 1/1971 | O'Connell | 52/64 X |
| 3,579,932 | 5/1971 | Atkinson | 52/83 |
| 3,815,299 | 6/1974 | Sorensen et al. | 52/66 |
| 4,175,361 | 11/1979 | Kumode | 52/66 |
| 4,581,860 | 4/1986 | Berger | 52/63 |

FOREIGN PATENT DOCUMENTS

| | | | |
|---|---|---|---|
| 692954 | 10/1979 | U.S.S.R. | 52/83 |

OTHER PUBLICATIONS

International Symposium on Spatial Roof Structures, *A Decade of Fabric Tension Structures for Permanent Buildings,* Sep. 1984.

*Primary Examiner*—Alfred C. Perham

*Attorney, Agent, or Firm*—Cooper, Dunham, Griffin & Moran

[57] ABSTRACT

A structure, such as for a full-size stadium roof, which has a retractable central portion capable of opening up about one-half of the total roof area. Two retractable roof panels, rectangular in plan, cover an area that can be larger than a football field, and move in the direction of the main axis of the stadium.

1 Claim, 11 Drawing Figures

RETRACTABLE STADIUM ROOF SYSTEM WITH RECTANGULAR OPENING

BACKGROUND AND SUMMARY OF THE INVENTION

The invention is in the field of structures for covering large areas, such as full size stadiums, and is particularly directed to a structure having a retractable roof. A structure having a partially retractable roof is illustrated at FIG. 6 of U.S. Pat. No. 4,581,860, in which the applicant herein is the inventor and which is hereby incorporated by reference. Other large-span structures for enclosing stadium-size spaces are discussed in a presentation of the inventor herein to the International Symposium on Spatial Roof Structures at Dortmund, Germany, Sept. 10, 1984 entitled "A Decade of Fabric Tension Structures for Permanent Buildings," and in the 12 references cited at pages 19 and 20 of the presentation. The presentation and its 12 references are hereby incorporated by reference in this specification.

It is believed that there is an increasing demand for covered full-size stadiums and similar structures to make sports and other events independent of the weather. On the other hand, there is a desire to retain the outdoor character of certain events whenever possible, which leads to the demand for retractable roofs. A major difficulty in designing and building a stadium-size structure with a retractable roof is the combination of size and movable parts. Full-size stadiums require free-span roof areas in the area of several hundred thousand feet, and roofs of this size and span to be economically and practically built and used require special structural techniques. In particular, structures of this type can make use of efficient geometries such as domes, saddles, etc., which have a circular, elliptic, or super elliptic boundary condition. Making the roof, or at least the central part of the roof, retractable generally makes those closed structural shapes difficult to implement, although one implementation of a partially retractable roof is shown in said prior patent of the inventor herein. A further consequence of a retractable design is that the movable sections of the roof have to fit the geometry of the structure in the open and closed positions, and this requirement can tend to dominate the geometry choices. One such requirement can be that the edges of the movable roof panels run on straight lines or circles. A further such requirement can be that the superimposed loads, such as wind and snow, have to be safely supported in the open and closed positions, and preferably in any intermediate state as well. Also, rain water has to run off in any position. The combined difficulty of these and other considerations is underscored by the fact that to the knowledge of the inventor herein no retractable stadium roofs have been built so far.

This invention provides a functional, structurally efficient, and economical solution for a full-size stadium roof which, in one nonlimiting example, has a retractable central portion which can open up approximately one-half of the total roof area. This is achieved by the choice of a unique geometric configuration and a unique combination of structural systems, materials and construction methods.

In one exemplary embodiment a central rectangular opening of the roof is covered by two retractable roof panels which are rectangular in plan and can cover an area substantially larger than a football field. The panels are substantially rigid, using trussed steel construction or similar rigid lightweight framing. They are covered with a structural fabric membrane or other lightweight roofing system, and move in the direction of the main axis of the stadium (in the case of a football or soccer field, the main axis is along the long direction of the field, and in the case of baseball it is a line through home plate and third base). The roof panels are high in the middle and low at the ends, thus allowing water to run off in any position of the panels. In the direction of the main axis the retractable panels follow a slight circular curve, to thereby ride on similarly curved tracks supported on track girders. Rollers between the panels and the track girders are arranged to resist downloads, uploads (e.g. from wind uplift), and lateral loads. The movement of the panels is generated by a hoist system similar to that of an elevator or cable car, with cables running along the track girders, which form the inboard edges of two fixed portions of the roof that flank the sides of the stadium field. Two other fixed portions of the roof flank the ends of the stadium field, and are under the curve along which the retractable panels move to their open positions. The track girders are the main longitudinal support members of the roof, running the total length of the stadium. They are suspended from the arches by respective cable systems similar to those used in a stay cable bridge. The upper support points of these suspension cables are a part of an arch which gathers the loads from all of the cables on one side, spanning over the length of the structure. Each arch in turn is laterally supported by a triangulated set of inclined struts which rest on a horizontal edge ring at the stadium perimeter. Horizontal tie cables extend between the two track beams to provide continuity of the system, spanning across the opening in the retractable portion of the roof.

An exemplary embodiment of the invention comprises two tracks which in plan view are parallel to each other and to a first axis of the stadium field, and in elevational view along the first axis are convex and conform an arc of a circle. Two arches in plan view are convex and circumscribe the tracks such that each track is along a chord of a respective arch. In elevational view along the first axis the arches are convex and have curvatures greater than those of the tracks to thereby extend above them. A substantially rigid, laterally extending edge ring in plan view generally follow the outline of the arches and in elevational views along the first axis extends along chords of the arches and tracks. A support, such as a system of columns, can be used to raise the edge ring above grade. The ends of the arches rest on rigid abutments which carry the arch forces into the foundations. Between these abutments the arches are laterally braced by two respective sets of triangulated, inwardly inclined struts, such as steel struts, which rest on the edge ring. The track girders are suspended from the arches by two respective triangulated sets of cables. Horizontal tie cables span from one track girder to another, and two respective sets of stabilizing cables connect the track girders to the edge ring. This system is prestressed and, together with the track girders, forms a sufficiently rigid support for the tracks. The roof panels form substantially rigid space frames covered with fabric or other lightweight roofing material shaped to drain water laterally onto the rigid, fixed portions of the roof at the sides of the stadium field. A system of hoist cables and winches is provided to selectively move the roof panels toward and away from each other along the tracks, to thereby close or open the roof of the structure.

DETAILED DESCRIPTION

Figure 1:
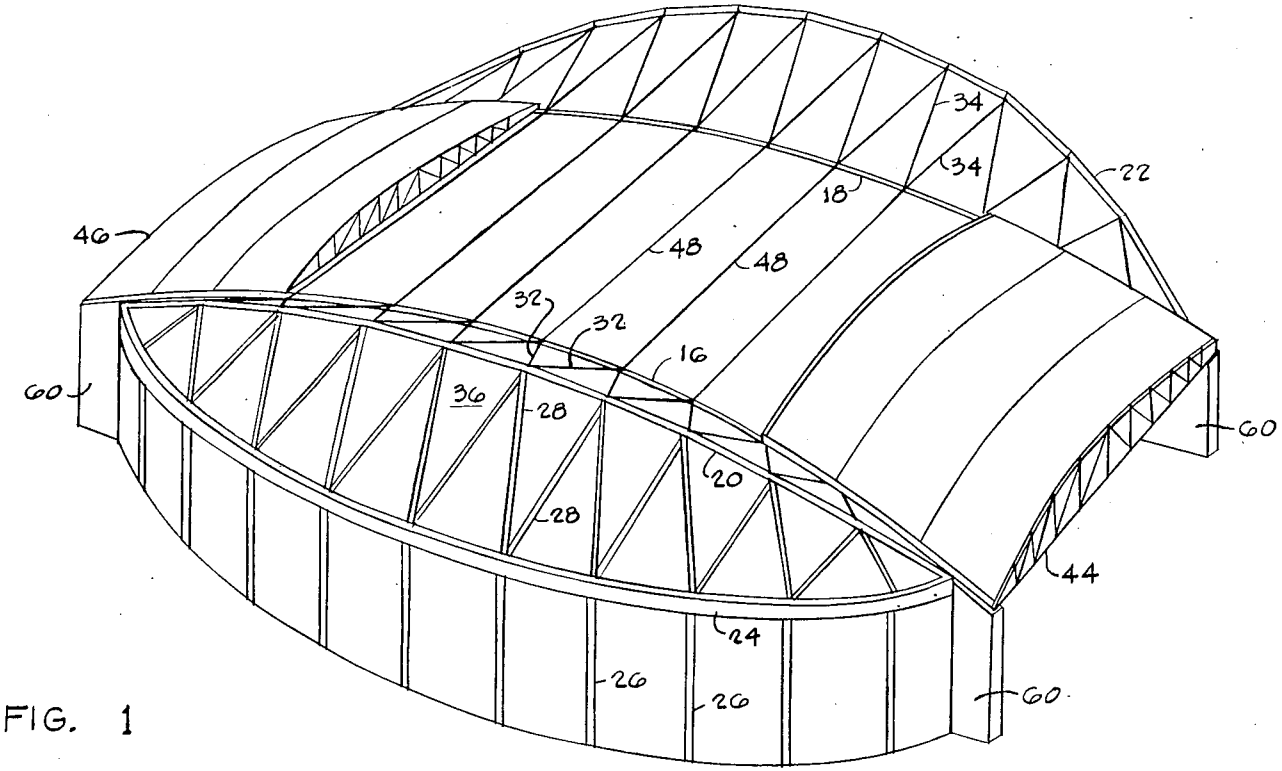
FIG. 1 is a perspective view of an embodiment of the invention.
Figure 2:
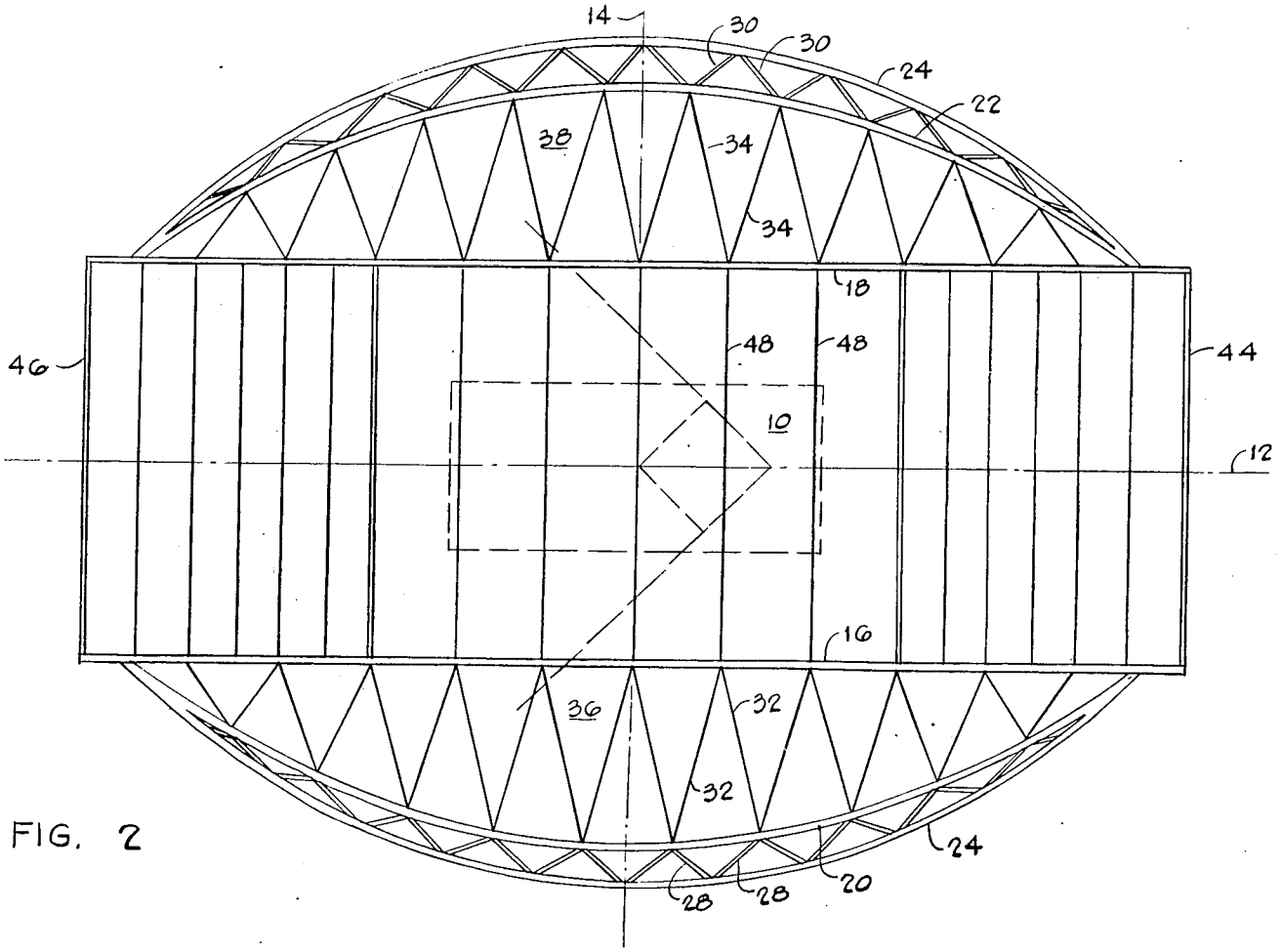
FIG. 2 is a plan view showing retractable roof panels in their open positions.
Figure 3:
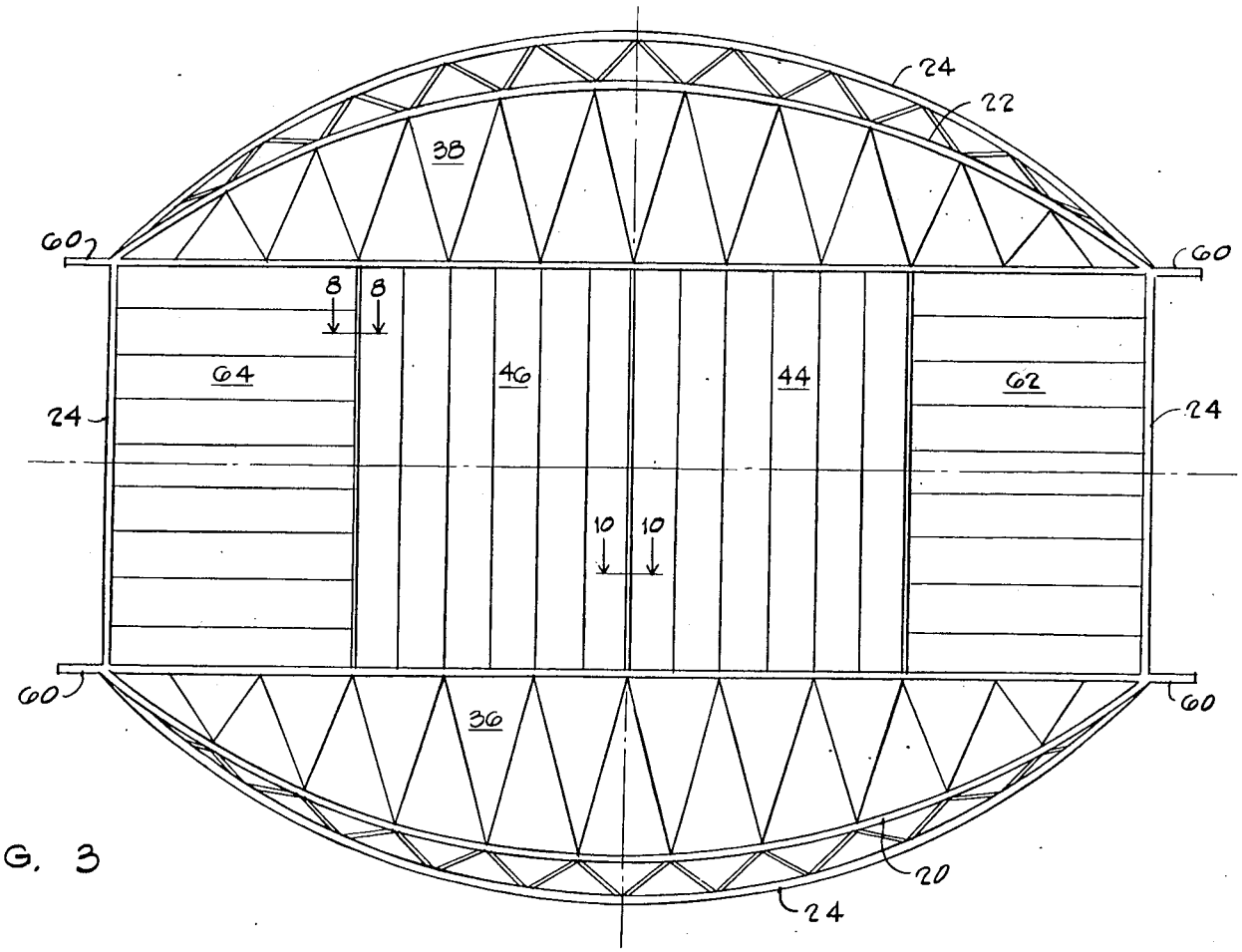
FIG. 3 is a plan view showing the retractable roof panels in their closed positions.
Figure 4:
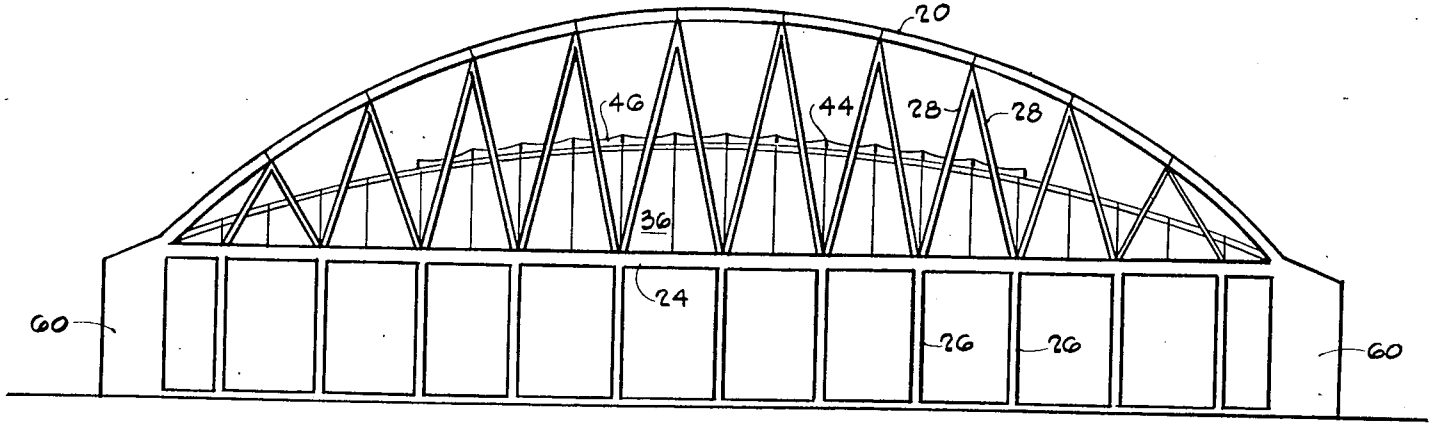
FIG. 4 is a sectional view along a first axis.
Figure 5:
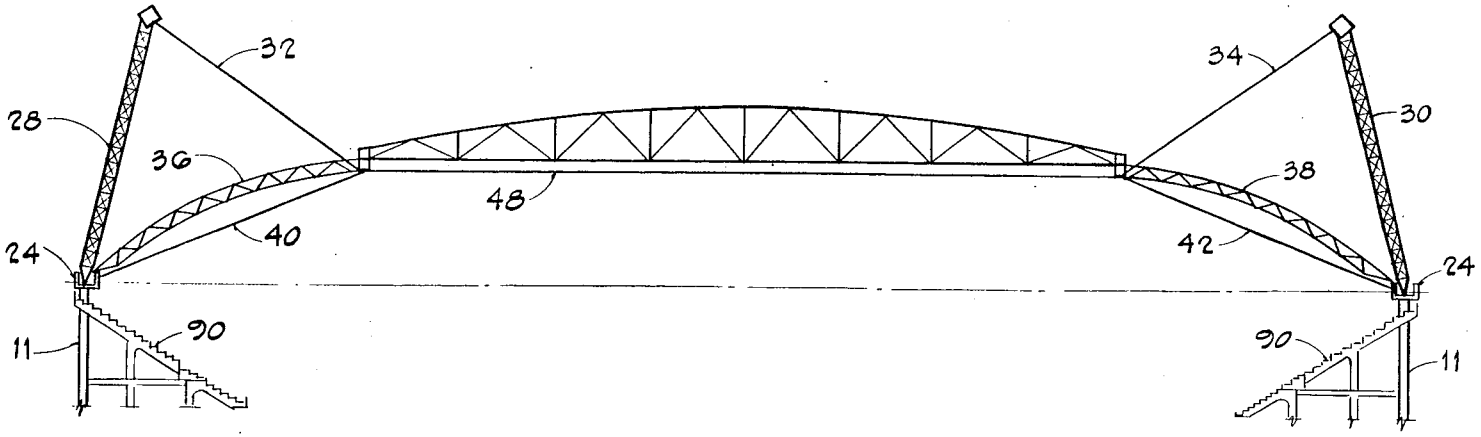
FIG. 5 is a sectional view along a second girder.
Figure 6:
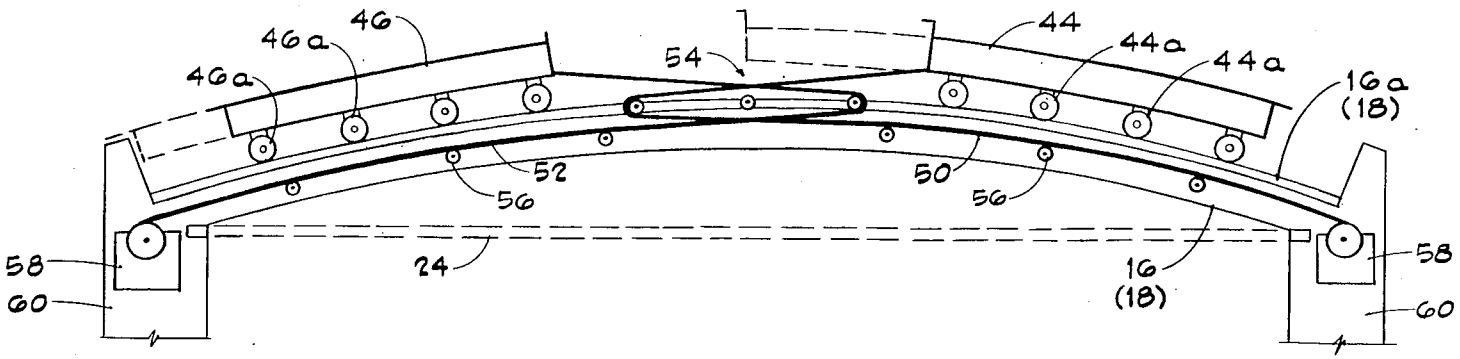
FIG. 6 is a sectional view along a track girder.

A retractable roof structure embodying an example of the invention covers a stadium field 10, such as a football, soccer or baseball field, and has a first axis 12 and a second axis 14. In the plan view of FIG. 2, track girders 16 and 18 are parallel to each other and to axis 12 and are spaced from each other by a substantial distance, which can be greater than the width of a football field. As best seen in FIGS. 1 and 6, in elevational view along axis 12 each track girder is convex and forms an arc of a circle. Track girders 16 and 18 are suspended from the respective arches 20 and 22 by respective sets of suspension cables 32 and 34, which are arranged in respectrve triangulated (or parallel) and outwardly inclined patterns, as best seen in FIGS. 1 and 5. Track girders 16 and 18 are stabilized by two respective sets of stabilizing cables 40 and 42, which are anchored to edge ring 24. The horizontal components of forces on the suspension cables and the stabilizing cables are balanced by a set of horizontal tie cables 48. In plan view, as seen in FIG. 2, arches 20 and 22 are convex and circumscribe track girders 16 and 18 such that each track girder is along a chord of the respective arch. In an elevational view along axis 12, as seen in FIG. 4, arches 20 and 22 also are convex, and have curvatures greater than those of track girders 16 and 18 to thereby extend above them. A substantially rigid, laterally extending edge ring 24 in plan view generally (but not necessarily exactly) follows arches 20 and 22 (as seen in FIG. 2) and in elevational view along axis 12 ring 24 extends along chords of the arches and track girder (as seen in FIG. 4. The ends of the arches are supported by abutments 60 which also form the anchor points of track girders 16 and 18 and of edge ring 24. These abutments 60 carry the resultant loads from the components anchored thereon into the foundations. A support, e.g. comprising columns 26, can be used to raise edge ring 24 above grade. Edge ring 24 can be polygonal, or elliptic at the sides of the stadium field and straight at the ends of the field. It need not be a complete ring if elements of the supports for stadium seats 90 are designed to carry the required loads from the roof system. Two sets of substantially rigid struts 28 and 30 extend up from edge ring 24 to the respective arches 20 and 22. Struts 28 and 30 can be in triangulated sets, as illustrated in FIGS. 1-4, or can be in parallel sets. Fixed side roof portions 36 and 38 extend generally laterally from the side portions of edge ring 24 to the respective track girders 16 and 18, and end fixed roof portions 62 and 64 extend from the ends of the roof structure to the rectangular opening for retractable panels 44 and 46. Retractable panels 44 and 46 run on tracks **16*a* and 18*a* of girders 16 and 18 on rollers 44*a* and 46*a*, which in plan view overlap the track, and in elevational view along axis 12 are on rotational centers on loci matching the curvature of the tracks, as best seen in FIG. 6. In elevational view along axis 14, as seen in FIG. 5, roof panels 44 and 46 are convex. Retracting means are provided for selectively moving the roof panels 44 and 46 toward and away from each other along track girders 16 and 18 to thereby close or open the roof of the structure. These means comprise hoist cables 50 and 52 trained over sheave wheels 54 and guide wheels 56 and moved in the desired direction by winch systems 58 housed at abutments 60**, to form a system similar to those used in cable cars and elevators.

Figure 7:
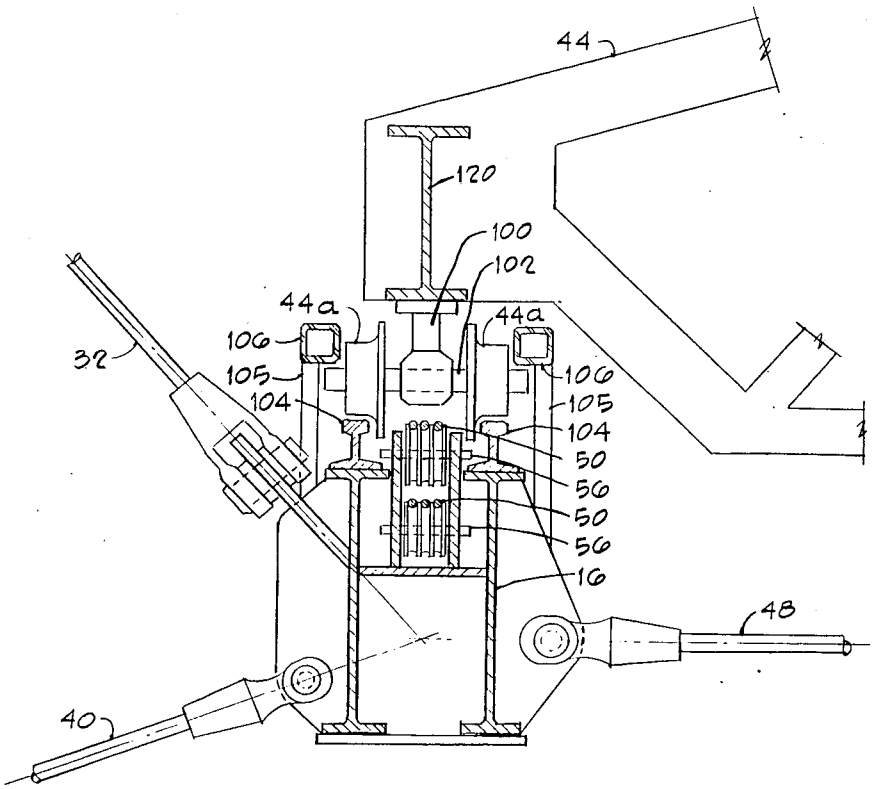
FIG. 7 is a sectional view across a track girder.

FIG. 7 illustrates the retracting system at track girder 16 and roof panel 44, but the same method is used for the other girder and roof panel. Suspended on struts 100 from an edge beam 120 of panel 44 are axles 102 each carrying rollers **44*a* which are similar to railroad wheels and ride on tracks 104 supported on girder 16. Upper tracks 106 are affixed to girder 16 through posts 105 and overlap the outboard ends of axles 102, to prevent lifting of panel 44 under extreme uplift loads. The forWard and return runs of hoist cables 56 are carried by guide whels 56. Some relative lateral movement is allowed between panel 44 and girder 16 by allowing strut 100 to ride on axle 102, but its extent is restricted by wheels 44*a***.

Figure 10:
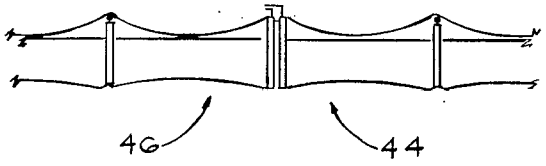
FIG. 10 is a partial sectional view taken at line 10—10 in FIG. 3.
Figure 11:
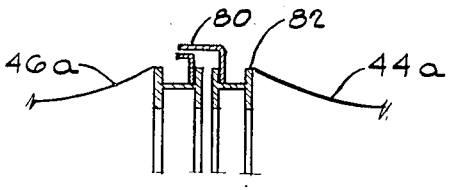
FIG. 11 show a detail of FIG. 10.
Figure 8:
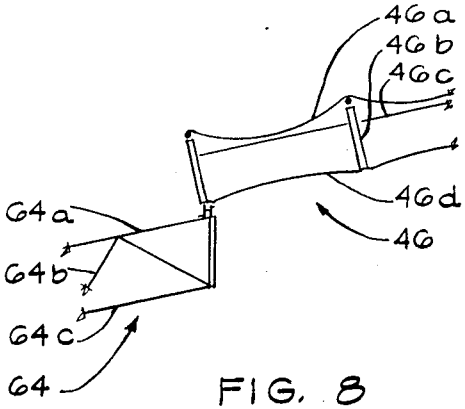
FIG. 8 is a partial sectional view taken at line 8—8 in FIG. 3.
Figure 9:
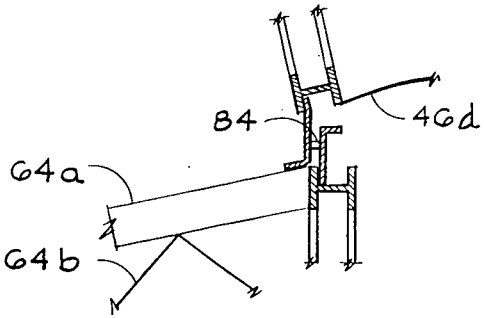
FIG. 9 shows a detail of FIG. 8.

FIG. 8 illustrates the joint between the fixed end roof portion 64 and the retractable panel 46 when in its closed position; the joint between 66 and 44 is similar. Each fixed roof portion can comprise a truss structure, such as the structure of truss members **64*b*, and can have roof skin such as at 64 a and a black-out curtain such as at 64*c*. Similarly, each retractable roof panel can comprise a truss structure of members such as 44*b* and truss members such as 44*c*, covered with roof skin such as 44*a* and if desired using a black-out curtain such as 46*d*. As seen in FIG. 9, the joint can be maintained watertight by ensuring that the edge member of the retractable panel overlaps the fixed roof end portions, for example by using the edge members illustrated in FIG. 9. FIG. 10 illustrates the joint between retractable panels 44 and 46 when they are in their closed positions. As visible in the detail of FIG. 11, a ledge member 80 on panel 44 overlaps the edge member of panel 46, and a compressible rubber tube 82 can be used to complete the seal. A similar tube 84 can be used for the same purpose in the joint illustrated in FIG. 9**.

The structure can be erected using generally conventional construction materials and methods. For example suitable foundations are provided and columns 26 and abutments 60 are erected, using reinforced concrete. Edge ring 24 is cast, preferably one segment at a time. Each arch is erected in sections, starting at an abutment 60. For example, starting at one abutment, the two nearest struts 28 are erected on edge ring 24, using structural steel frames, and are joined at a top node and held at the correct inward inclination, for example by temporary bracing cables or struts. A section of an arch steel frame is then assembled and moved into place to span from its anchor point on the abutment to the strut node. The next two struts 28 are then similarly erected and held in place, and another steel frame section of the arch is used to span between the two strut nodes, and so on until the steel frame of an arch is completed. Concrete can then be pumped into forms supported on the steel frame of the arch, using the frame as reinforcing steel. The track girders can be assembled on the ground, preferably in sections, and lifted in position using the completed arches as support points, and the sections affixed to each other to complete the girders and tracks. Tie cables 48 can then be strung and prestressed. The fixed roof portions can be erected using conventional truss techniques. The retractable panels can be assembled on the ground, one truss span at a time, lifted in position by canting them relative to tie cables 48, and the assembly and attachment of roof skin completed in place.

I claim:

1. A retractable roof structure for covering a field having a first axis and a second axis comprising:

two tracks which in plan view are parallel to each other and to the first axis and in elevational view along the first axis are convex and form an arc of a circle;

two arches which in plan view are convex and circumscribe the tracks such that each track is along a chord of a respective arch, and in elevational view along the first axis also are convex but have curvatures greater than those of the tracks, to thereby extend above the tracks;

a substantially rigid, laterally extending edge ring which in plan view generally follows the arches and in elevational view along the first axis extends along chords of the arches and tracks;

a support for raising the edge ring above grade;

two sets of substantially rigid arch support struts which extend up from the edge ring to the respective arches;

two sets of track suspending cables which extend down from the arches to the respective tracks;

two fixed roof portions which extend from the edge ring to the respective tracks;

two retractable roof panels having runners which in plan view overlap the tracks and match the curvature of the tracks in elevational view along the first axis, wherein the roof panels are convex in elevational view along the second axis;

a set of tie cables extending between the two tracks; and means for selectively moving the roof panels toward and away from each other along the tracks to thereby close or open the roof of the structure.

* * * * *